US005303447A

United States Patent [19]

McKnight

[11] Patent Number: 5,303,447

[45] Date of Patent: Apr. 19, 1994

[54] HOSE AND TOOL RACK FOR UPRIGHT VACUUM CLEANER AND METHOD FOR MOUNTING SAME

[75] Inventor: Darwin T. McKnight, Louisville, Ohio

[73] Assignee: The Hoover Company, North Canton, Ohio

[21] Appl. No.: 952,664

[22] Filed: Sep. 28, 1992

Related U.S. Application Data

[63] Continuation-in-part of Ser. No. 828,641, Jan. 30, 1992.

[51] Int. Cl.[5] ..... A47L 9/00

[52] U.S. Cl. ..... 15/323; 15/246.2

[58] Field of Search ..... 15/323, 334, 335, 246.2

[56] References Cited

U.S. PATENT DOCUMENTS

| | | | |
|---|---|---|---|
| D. 205,452 | 8/1966 | Wahl | 22/3 |
| D. 263,235 | 3/1982 | Akita | D32/22 |
| D. 299,176 | 12/1988 | Bowerman | D32/22 |
| D. 301,784 | 6/1989 | Petralia et al. | D32/22 |
| D. 309,203 | 6/1990 | Goodrich | D32/22 |
| D. 309,806 | 8/1990 | Chieda et al. | D32/22 |
| D. 316,167 | 4/1991 | Petralia et al. | D32/22 |
| D. 330,616 | 10/1992 | Wareham et al. | D32/31 |
| 1,936,761 | 11/1933 | Hoover | 15/334 |
| 2,046,684 | 7/1936 | Hoover | 15/334 |
| 2,854,686 | 10/1958 | Hansen | 15/327 |
| 4,541,142 | 9/1985 | Pudwill | 15/323 |
| 4,809,393 | 3/1989 | Goodrich et al. | 15/323 |

FOREIGN PATENT DOCUMENTS 2641457A 7/1989 France .

OTHER PUBLICATIONS

U.S. Electrolux Advantage Purchased Oct. 31, 1989.
Royal Dirt Devil 7200 Purchased Aug. 2, 1990.
UK Electrolux Pulse Contour Power Purchased Nov. 1, 1990.
Kent KC-152 Purchased Jan. 25, 1991.
UK Goblin Laser 500 Purchased Jul. 23, 1991.
UK Goblin Laser 3000i Purchased Jul. 23, 1991.

*Primary Examiner*—Chris K. Moore

[57] ABSTRACT

A rear mounted hose and tool rack is provided for an upright vacuum cleaner. The hose and tool rack receives and maintains various tools and attachments within a confined envelope and maintained rearwardly of the lower handle assembly of the vacuum cleaner. The rack is formed of a flexible plastic material to accommodate ease of attachment thereto. A central opening in the rack may be passed over the upper handle assembly such that a pocket at the top of the opening may engage an upper surface of the lower handle assembly while spaced apart tabs extending into the opening engage opposite surfaces of the lower handle assembly to complete the secured engagement. Attachment of the rack to the upright cleaner is further facilitated by the flexible and deflectable nature of the rack itself which allows the tabs to be deflected while being positioned for ultimate secured engagement. The central opening of the rack is substantially congruent with the lower handle assembly configuration to provide further strength and rigidity to the final structure.

21 Claims, 5 Drawing Sheets

HOSE AND TOOL RACK FOR UPRIGHT VACUUM CLEANER AND METHOD FOR MOUNTING SAME

RELATED APPLICATIONS

This Application is a continuation-in-part of application Ser. No. 07/828,641, filed Jan. 30, 1992 and owned by a common assignee.

TECHNICAL FIELD

The invention herein resides in the art of vacuum cleaner devices and, more particularly, to a hose and tool rack for implementation with a vacuum cleaner. Specifically, the invention relates to a hose and tool rack adapted for ease of transverse attachment to the lower handle assembly of an upright vacuum cleaner.

BACKGROUND ART

Vacuum cleaners are in common use in virtually every household and business in the country. Such vacuum cleaners are typically employed to clean floor surfaces, as well as above floor areas such as furniture, drapes, moldings, and the like. Consumers have typically perceived that an upright cleaner is best suited for cleaning carpeted floor surfaces and rugs, while canister cleaners are better suited for the aforementioned above floor cleaning. Since many consumers find it undesirable or uneconomical to own and operate both a canister and upright cleaner, it is most desirable that a single vacuum cleaner be provided with the benefits attributed to both.

Recently, it has become popular to provide an upright vacuum cleaner with above floor cleaning attachments including, by way of example, hoses, wands, and cleaning tools such as dust brushes, furniture nozzles, and crevice tools. Tool racks have now been proposed for implementation with upright cleaners for the purpose of maintaining the requisite attachments in continual association with the upright cleaner and providing a means for storing the same when such attachments are not in use.

Presently, retail establishments insist that vacuum cleaners and the like be maintained in cartons or boxes at the point of sale and that the dimensional size of such cartons or boxes be minimal. Accordingly, upright cleaners are typically sold in cartons containing three or more primary parts including a vacuum head, a lower handle assembly, an upper handle assembly, and a dust bag, if required. The addition of attachments in the form of hoses, wands and tools, coupled with the need for a rack to receive the same, greatly complicates the task of facilitating assembly for the consumer while also accommodating separability of the rack from the remainder of the cleaner for purposes of packaging.

It is also desired that the hose and tool rack be unobtrusive and not significantly add to the dimensional size of the associated cleaner or impede its maneuverability. Accordingly, it is desired that the hose and tool rack remain substantially within an envelope defined by the size of the vacuum head or cleaner body of the cleaner itself while still providing sufficient storage capability to receive and maintain the various tools and attachments.

DISCLOSURE OF INVENTION

In light of the foregoing, it is a first aspect of the invention to provide a hose and tool rack for an upright vacuum cleaner which is transversely mounted to the lower handle assembly.

Another aspect of the invention is to provide a hose and tool rack for an upright vacuum cleaner which provides for storage of tools and attachments in an unobtrusive envelope.

Still a further aspect of the invention is the provision of a hose and tool rack for an upright vacuum cleaner which is easily separable and attachable to the vacuum cleaner, accommodating packaging of the vacuum cleaner as separate component parts.

An additional aspect of the invention is the provision of a method for easily, yet securely attaching a hose and tool rack transversely across the lower handle assembly of an upright vacuum cleaner and further accommodating ease of removal of the same.

Yet an additional aspect of the invention is the provision of a hose and tool rack for an upright vacuum cleaner which, though easily attachable and separable from the vacuum cleaner, is secure when attached thereto.

Still a further aspect of the invention is the provision of a hose and tool rack for an upright vacuum cleaner which is conducive to implementation with presently existing upright cleaners and which may be implemented with state of the art technology.

The foregoing and other aspects of the invention which will become apparent as the detailed description proceeds are achieved by a hose and tool rack for use with an upright vacuum cleaner, comprising: a generally vertically elongated rectangular frame having a central aperture; sidewardly mounted hose clips extending and opening outwardly from said rectangular frame for reception and maintenance of the hose loopingly around at least a portion of said frame; at least one cleaning tool mounted on said frame and within a loop defined by the hose; and means carried by said frame for engaging the vacuum cleaner and attaching the hose and tool rack thereto.

Yet additional aspects of the invention which will become apparent herein are attained by a method for attaching a rectangularly shaped hose and tool rack having a central aperture to a vacuum cleaner, comprising: placing the hose and tool rack over a handle of the vacuum cleaner, causing said handle to pass through the aperture; engaging a top portion of the hose and tool rack with a top portion of a lower handle assembly of the vacuum cleaner; and engaging a bottom portion of the hose and tool rack with a bottom portion of the lower handle assembly of the vacuum cleaner.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
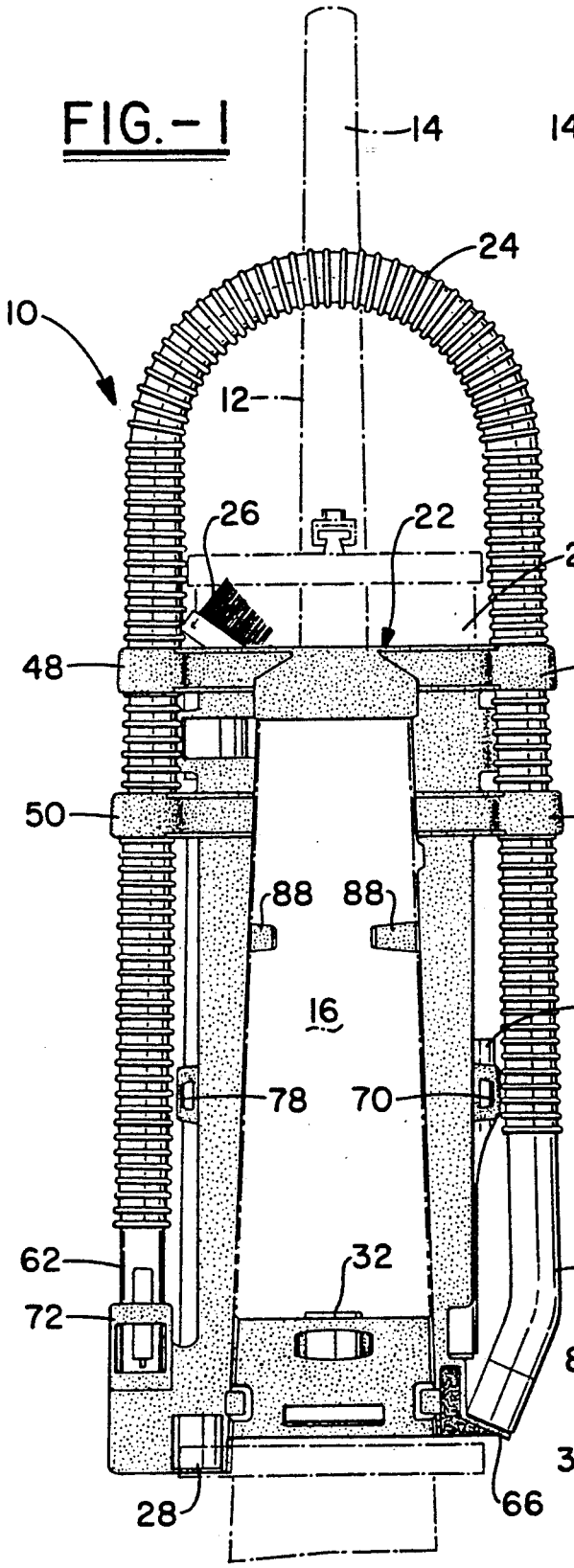
FIG. 1 is a front elevational view of the hose and tool rack of the invention in the environment of the upper and lower handle assemblies of a vacuum cleaner which are shown in phantom.
Figure 2:
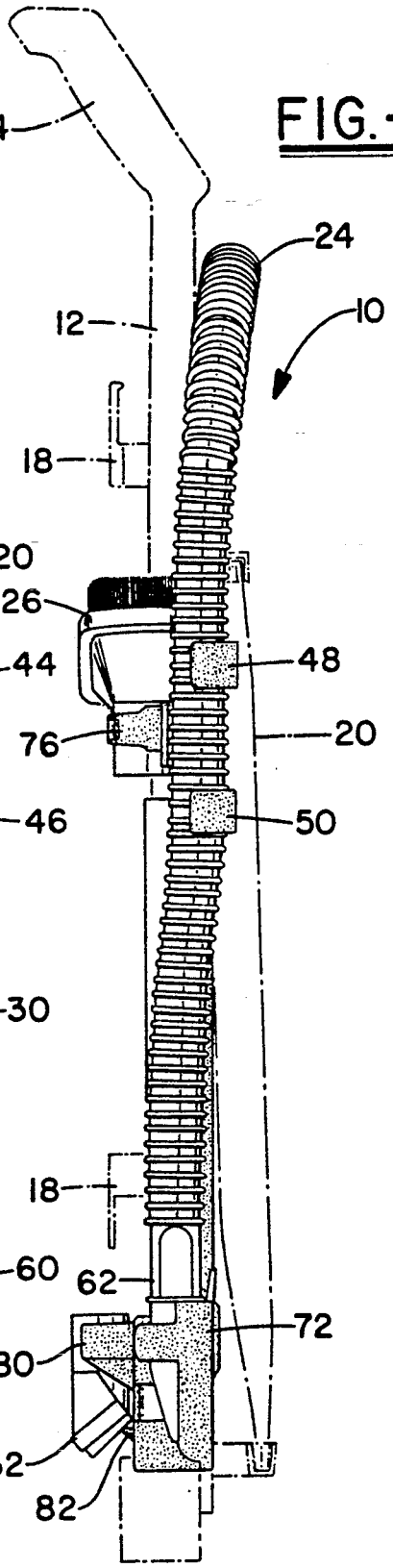
FIG. 2 is a side elevational view of the structure of FIG. 1.
Figure 3:
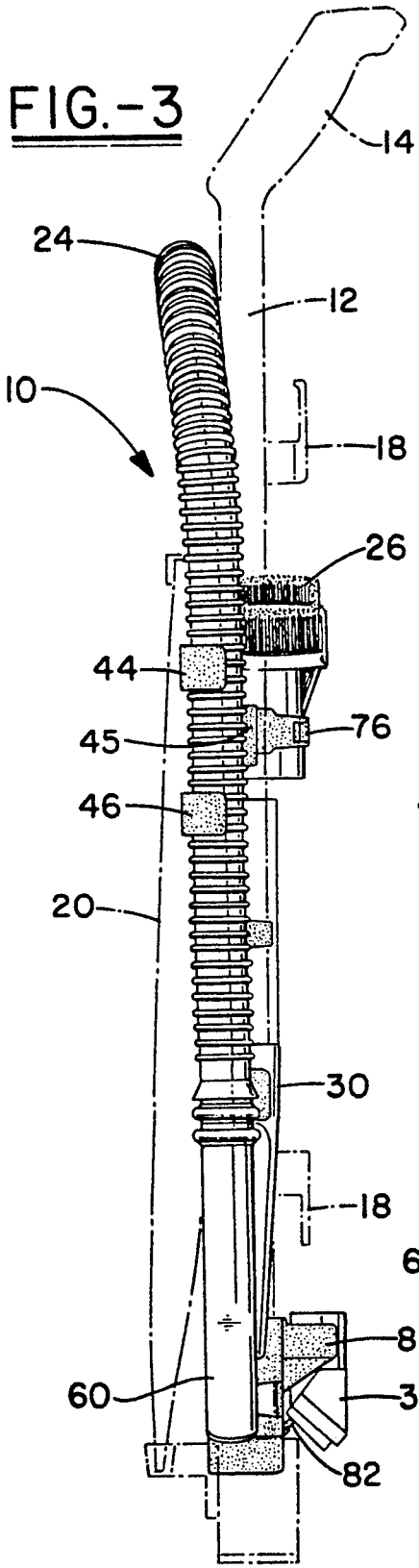
FIG. 3 is a side elevational view of the structure of FIG. 1 taken from a side opposite that of FIG. 2.

Referring now to the drawings and more particularly FIGS. 1–4, it can be seen that a handle and rack assembly of an upright vacuum cleaner according to the invention is designated generally by the numeral 10. The assembly 10 includes an upper handle assembly 12 having a hand grip 14 extending at an angle from a top end thereof to accommodate the hand of the user. A lower handle assembly 16 is interconnected with the upper handle assembly 12 and is adapted to be received by the vacuum power head of the upright cleaner in a manner well known and understood by those skilled in the art. Similarly, it will be understood that the handle assemblies 12, 16 typically comprise molded plastic housings or are of other suitable construction.

Cord hooks 18 are provided in spaced apart relationship on the back of the handle and rack assembly 10, one such cord hook 18 is connected to the back of the upper handle assembly 12, while the other is connected to the back of the lower handle assembly 16. In standard fashion, a power cord is typically looped between the two.

Also in somewhat standard fashion, a dust bag 20, if required as a result of the nature of the vacuum cleaner, is also provided in attachment with the handle assemblies 12, 16. In the embodiment shown, the dust bag 20 is attached to the front of the assemblies 12, 16, and such attachment is the preferred attachment for implementation with the transversely mounted hose and tool rack of the invention as described below.

FIGS. 1–4 show the upper and lower handle assemblies 12, 16 and the dust bag 20 in phantom. Such illustration is presented only for the purpose of highlighting the novel features of the hose and tool rack assembly 22 which will be discussed below, and for purposes of demonstrating the environment for use of the hose and tool rack assembly 22.

With continued reference to FIGS. 1–4, it will be appreciated that the hose and tool rack assembly 22 is received by and secured to the lower handle assembly 16 and is adapted to receive a number of implements, including a looped flexible hose 24 which extends over the front surface of the upper handle assembly 12, a dust brush 26, a wand 28, a crevice tool 30, and a furniture nozzle 32. Of course, the concept of the invention may be readily extended to accommodate various other implements and tools as well.

Figure 5:
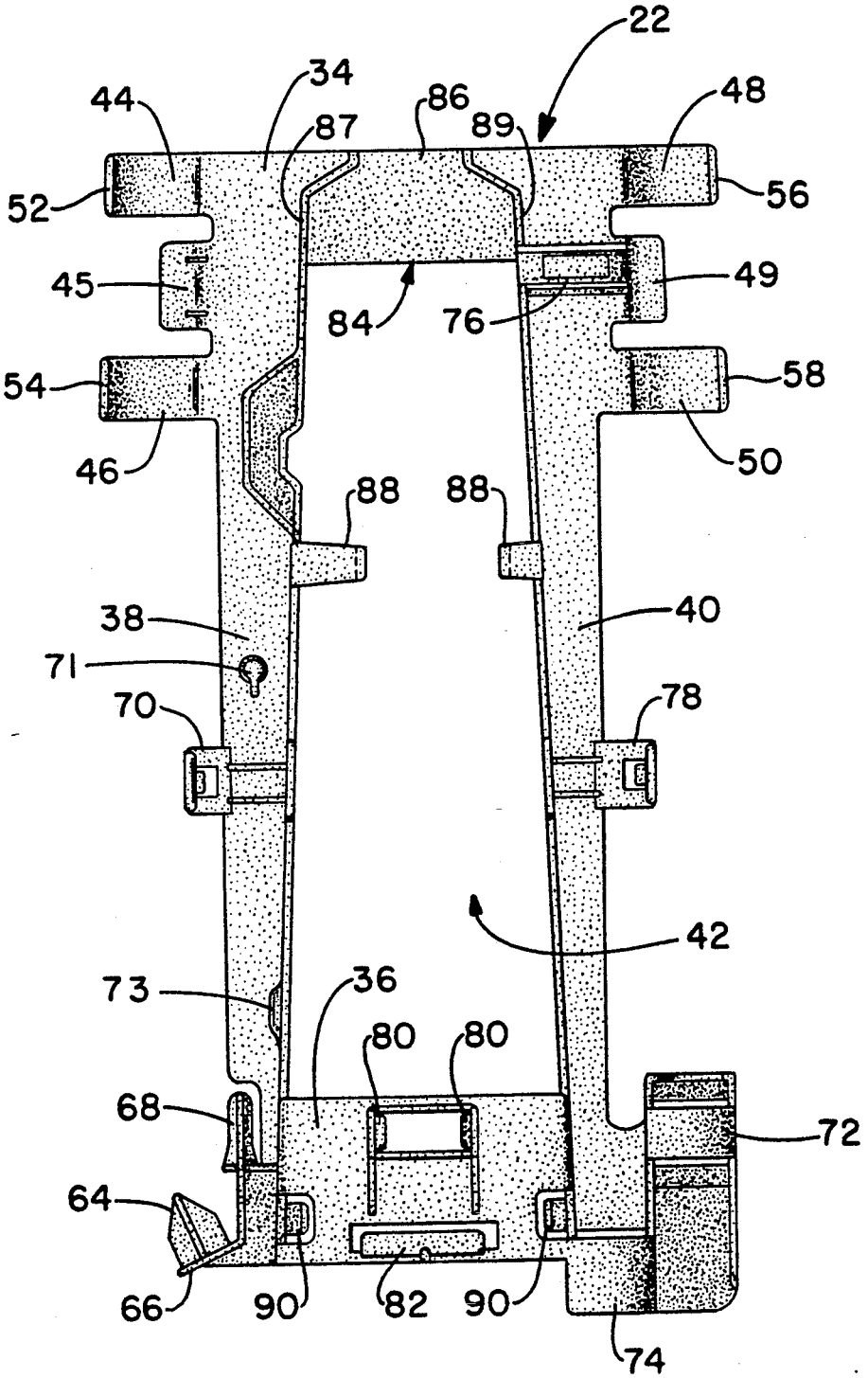
FIG. 5 is a rear elevational view of the hose and tool rack of the invention shown apart from the vacuum cleaner.
Figure 6:
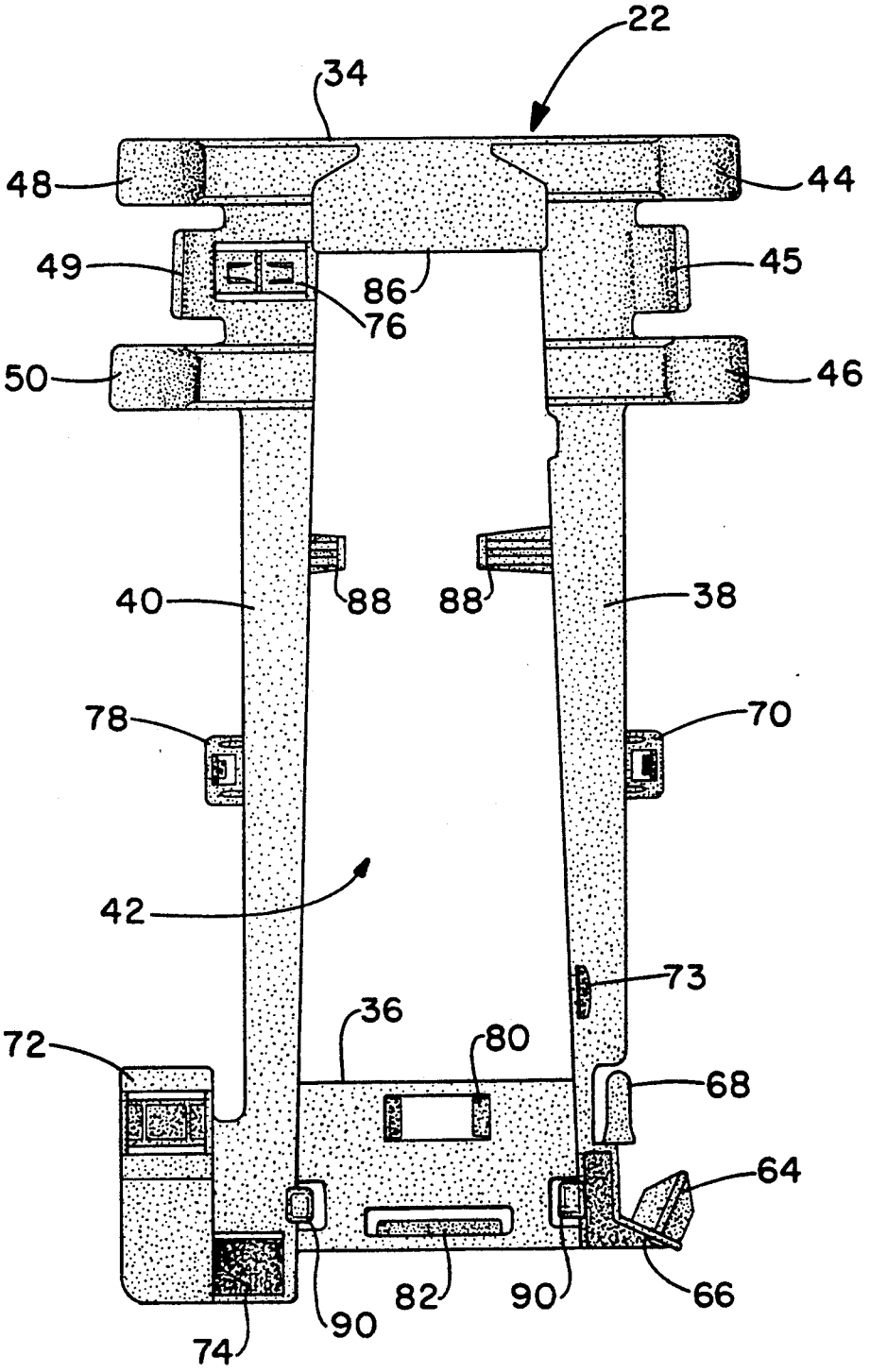
FIG. 6 is a front elevational view of the hose and tool rack of the invention shown apart from the vacuum cleaner.

As best shown in FIGS. 5 and 6, the hose and tool rack assembly 22 consists of an upper cross strut member 34 which is spaced apart from a lower cross strut member 36, the upper and lower cross strut members being interconnected by a pair of vertical strut members 38, 40 as shown. It will be readily appreciated that the strut members 34, 36, 38, 40 define a generally rectangular structure having a generally rectangular, or slightly trapezoidal, opening 42 established therewithin.

With continuing reference to FIGS. 1–6, it can be seen that clip members 44, 46 extend from the vertical strut member 38, while corresponding clip members 48, 50 extend from the vertical strut 40. The clip members 44, 50 are each provided with arcuate receptacles at the ends thereof defined by the arcuate end members 52, 54, 56, 58. Interposed between the pairs of clips 44, 46 and 48, 50 are respective arcuate retainers 45, 49. As is apparent from FIGS. 1–4, the hose 24 is received by the arcuate receptacles 52, 54, 56, 58 of the clip members 44, 46, 48, 50, with the hose 24 being retained by the interposed retainers 45, 49 engaging the hose 24 on sides opposite the engagement of clip members 44, 46, 48, 50.

A hose nozzle 60 extending from one end of the hose 24 is adapted to receive and engage a tool when desired. In like manner, the opposite end of the hose 24 is characterized by a hose connector 62 adapted to be received by an appropriate vacuum source. When the hose 24 is to be stored as illustrated in FIGS. 1–4, the hose nozzle 60 is received over a conical receptacle 64 which enters into the cylindrical opening at the end of the hose nozzle 60. The conical receptacle 64 is received upon an angled member 66 which is maintained at an appropriate angle to accommodate the dog leg of the hose nozzle 60 which is apparent from FIGS. 1 and 4. On the opposite side of the bottom portion of the hose and tool rack assembly 22 is a tubular receptacle 72 adapted to receive and maintain the hose connector 62 as illustrated. In the preferred embodiment of the invention, the conical receptacle 64 is maintained at the bottom of the vertical strut 38, while the tubular receptacle 72 is maintained at the bottom of the vertical strut 40. Of course, such positioning may be interchanged or modified. In either event, the hose 24 preferably loops upwardly from the bottom of one vertical strut to the other.

A blade member 68 extends from the angled member 66 and is adapted to receive the tapered working end of the crevice tool 30. A clip 70 extends from the vertical strut member 38 and is aligned with the blade member 68 to grippingly receive the opposite end of the crevice tool 30 which is adapted for engagement with the hose nozzle 60. A deflection member 73 is provided in the form of an arcuate surface extending from the vertical strut 38 in such a position as to serve as a guide for the crevice tool 30 to assure mating engagement with the blade member 68. A keeper 71 extends outwardly from the strut 38 above and in general alignment with the clip 70 to preclude disengaging vertical movement of the tool 30. Accordingly, the crevice tool 30 is secured at both ends by the hose and tool rack assembly 22.

Figure 4:
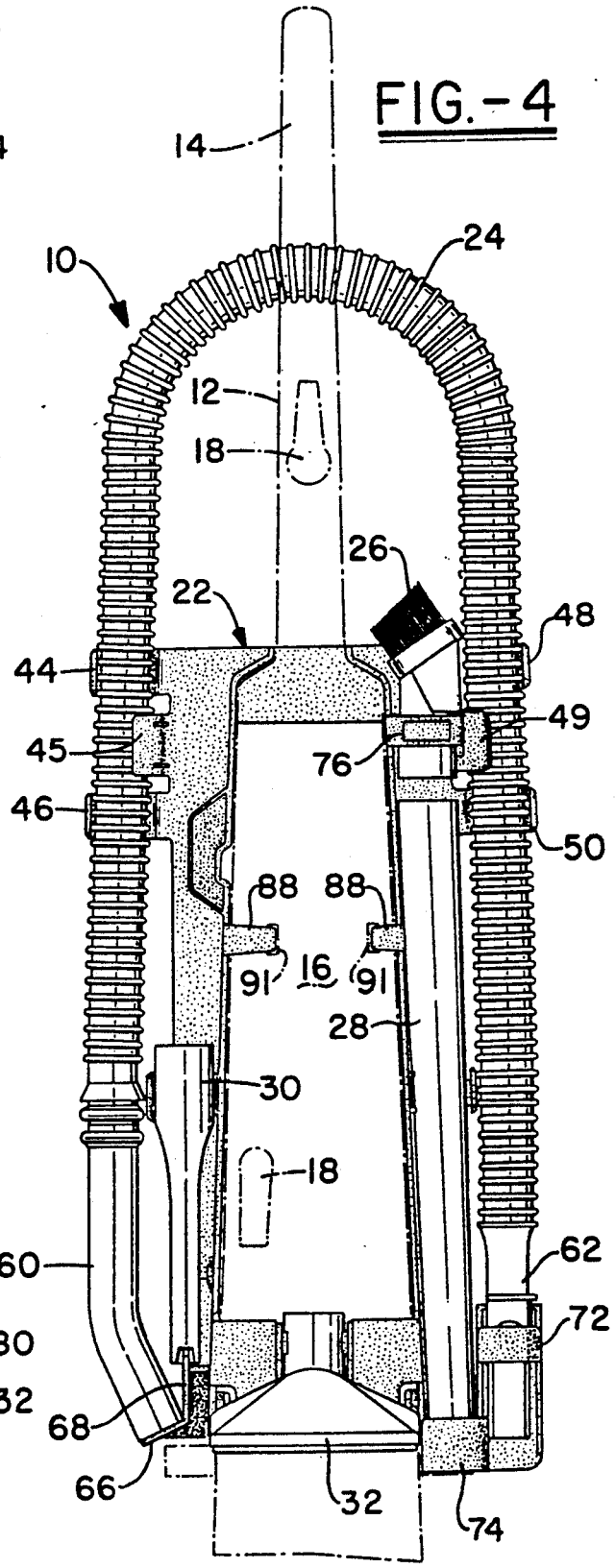
FIG. 4 is a rear elevational view of the structure of FIG. 1.

As shown in FIGS. 4 and 5, tubular receptacle 74 is positioned at the bottom of the vertical strut 40 and is adapted for receiving an end of the wand 28. An upper receptacle 76, in the form of a sleeve, clip, or the like, is also maintained on the vertical strut 40 to receive and retain the dust brush 26. A clip 78 extends from the vertical strut member 40 and is positioned between the receptacles 74, 76 to engage the wand 78 at about its midsection. Accordingly, the brush 26 and wand 28 are readily available and may be easily removed and replaced when desired.

A pair of clips 80 extend from a rear surface of the lower cross strut member 36 and are positioned above a horizontal rest member or lip 82 similarly extending from the cross strut 36. A furniture nozzle tool 32 is grippingly received between the clips 80 and is adapted to be received by and rest upon the lip 82 which extends into the nozzle opening.

The upper cross strut 34 has a pocket 84 which has a cover 86 extending along the front surface of the strut 34 between the vertical struts 38, 40. The pocket 84 is open at the back and defined by the cover 86 and the inner side edges 87, 89 of the struts 38, 40 to be contoured and configured to receive a top end portion of the lower handle assembly 16 and to nest the same therein when the hose and tool rack 22 is received by the vacuum cleaner. For further purposes of making secured engagement between the rack 22 and the lower handle assembly 16, L-shaped flexible tabs 88 extend from the vertical struts 38, 40 as shown. In the preferred embodiment of the invention, the L-shaped clips or tabs 88 are positioned at about the middle or upper middle portion of the opening 42 and are adapted to engage with respective slots 91 in the back surface of the lower handle assembly 16. In like manner, flexible L-shaped tabs 90 extend from the vertical struts 38, 40 at the bottom ends thereof and in alignment with the lower cross strut 36 and are positioned to engage a lip or edge of a front surface of the lower handle assembly 16. It will be appreciated that the lower strut 36 is spaced apart from the flexible L-shaped tabs 90 a distance substantially equal to the thickness of the housing of the lower handle assembly 16 at the point of final engagement, the L-shaped clips or tabs 90 engaging a front surface thereof, and the cross strut 36 engaging a rear surface thereof.

As will become further apparent herein, the pocket 84 of the hose and tool rack assembly 22 nests with an upper front portion of the lower handle assembly 16, while the cross strut 36 defines an open fronted channel configured to receive a lower rear portion of the lower handle assembly 16. Accordingly, the hose and tool rack assembly 22 transversely mounts the assembly 16.

When received by the consumer, the upper handle assembly 14, lower handle assembly 16, bag 20, cleaner body, and hose and tool rack assembly 22 will typically be separate and distinct units, packaged for assembly by the consumer. The actual assembly of the handle assemblies 12, 16, bag 20 and vacuum power head may proceed in standard fashion. The invention herein concentrates upon the ease of attachment of the hose and tool rack 22 to the lower handle assembly 16, such attachment being illustrated in FIGS. 7–9.

Figure 7:
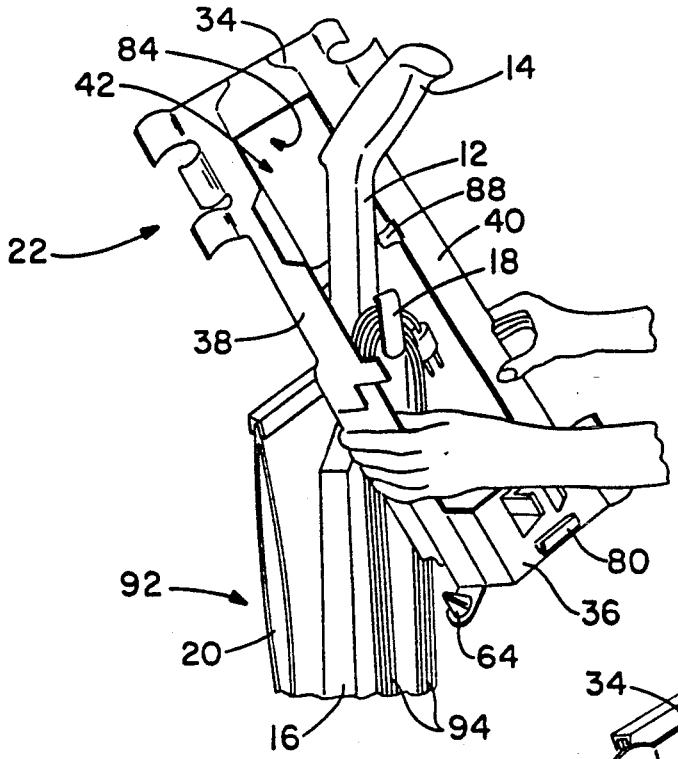
FIG. 7 is an illustrative view of an upright vacuum cleaner and the hose and tool rack of the invention, showing the rack being maneuvered over the upper handle assembly.
Figure 8:
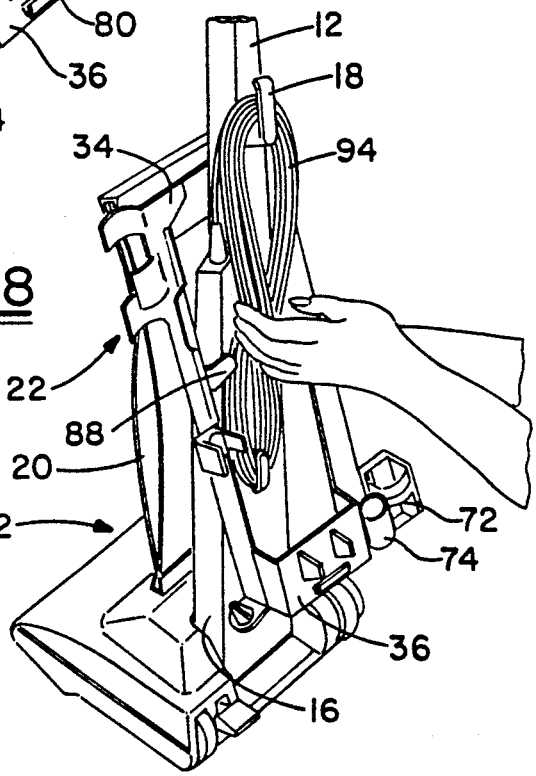
FIG. 8 is an illustrative view of a further step in attaching the hose and tool rack of the invention to an upright vacuum cleaner.

It will be appreciated that the rack 22 is preferably molded of plastic which is flexible and forgiving in nature, having a natural tendency when deflected to return to its original molded shape. With this understanding, and with reference to FIGS. 7–9, an appreciation of the attachment of the rack 22 to an upright cleaner 92 can be obtained. As illustrated in FIG. 7, the opening 42 of the rack 22 is passed over the handle grip 14 and upper handle assembly 12 of the vacuum cleaner 92. In FIG. 8, the rack 22 is slid downwardly and onto the lower handle assembly 16, with the L-shaped clips 88 engaging slots 91 of a back surface of the lower handle assembly 16 and with the pocket 84 engaging and matingly nesting an upper end thereof. With the cord 94 mounted between the cord hooks 18, the operator needs simply deflect, move, or unwind the cord 94 to facilitate such operation, as shown.

Figure 9:
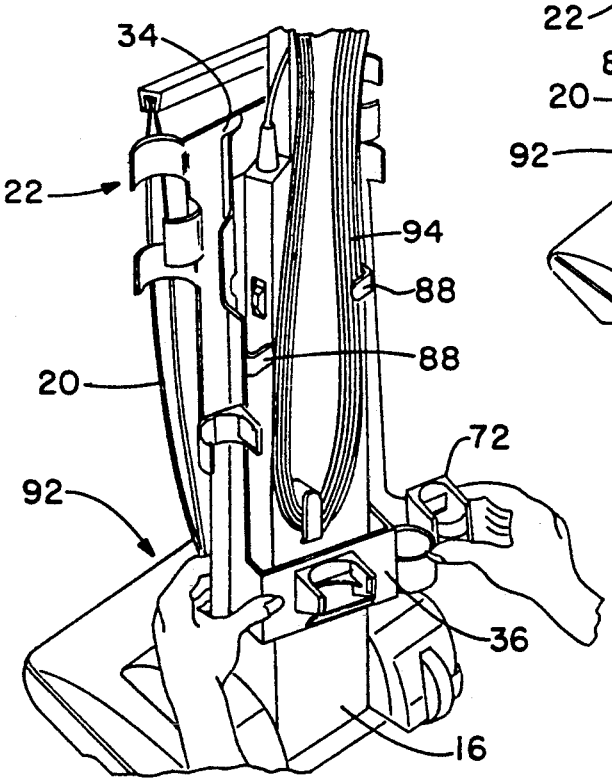
FIG. 9 is an illustrative view of the step of deflecting a bottom portion of the hose and tool rack to accommodate the interengagement with the lower handle assembly.

In FIG. 9, the rack 22 is positioned in alignment with the lower handle assembly 16, the upper portion of which is received within the pocket 84, and which is further secured by the engagement of the clips 88 in the slots 91 of the back surface of the lower handle assembly 16. To complete the attachment of the rack 22, the flexible L-shaped tabs 90 at the lower ends of the vertical struts 38, 40 need to be engaged with the external lip or edge of the front surface of the lower handle assembly 16. The flexible nature of the structure of the rack 22 facilitates this operation. As shown in FIG. 9, the lower cross strut 36 is arched or bent as the bottom end portions of the vertical struts 38, 40 are separatingly rotated to allow the flexible tabs or clips 90 to separate sufficiently to deflect over or to pass along the side edges of the lower handle assembly 16 and be urged to the front thereof. When so positioned, the deflecting force applied by the operator to the bottom cross strut 36 is released and the flexible and recoverable nature of the plastic from which the rack 22 is formed allows the flexible I-shaped tabs 90 to pass over the front surface of the lower handle assembly 16. Accordingly, the rack 22 is secured at the top by nesting engagement of the lower handle assembly 16 within the pocket 84, at the center by the engagement of the flexible tabs 88 on the back surface, and at the bottom by engagement of the flexible tabs 90 on the front surface. Further stability is provided by the engagement of the channel-shaped cross strut 36 at the back surface of the lower handle assembly 16 opposite the engagement of the flexible tabs 90.

Of course, it is preferred that the hose and tool rack 22 be interconnected with the upright vacuum cleaner 92 with the tools, hose, and wand removed. Subsequent to the assembly demonstrated in FIGS. 7–9, the tools may be inserted into the areas designated in FIGS. 1–4. It will be particularly noted that it is preferred that the hose 24 be looped in front, rather than behind, the upper handle assembly 12 such that, in use, the assembly 12 supports the hose 24.

Those skilled in the art will readily appreciate that the process for removing the hose and tool rack 22 follows in reverse the procedure just described with respect to assembly, the same being quickly and easily achieved by simple manipulation of the rack 22 itself.

It will further be appreciated that the tapered nature of the opening 42, being slightly wider at the bottom than at the top, allows for ease of attachment of the hose rack 22 to the lower handle assembly 16 which has a similar configuration. With the rack 22 in place as just described, the opening 42 is filled by the substantially congruent lower handle assembly 16, the same adding further to the structural integrity of the total system.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A hose and tool rack for use with an upright vacuum cleaner, comprising:

a generally vertically elongated rectangular frame having a central aperture;

sidewardly mounted hose clips extending and opening outwardly from said rectangular frame for reception and maintenance of the hose loopingly around at least a portion of said frame;

at least one cleaning tool mounted on said frame and within a loop defined by the hose; and means carried by said frame for engaging the vacuum cleaner and attaching the hose and tool rack thereto.

2. The hose and tool rack according to claim 1, wherein said central aperture receives a lower handle assembly of the vacuum cleaner, said central aperture and lower handle assembly being substantially congruent for nesting interengagement.

3. The hose and tool rack according to claim 2, wherein said frame comprises a pair of vertical side strut members interconnected by upper and lower cross strut members, said upper and lower cross strut members engaging the lower handle assembly on opposite surfaces.

4. The hose and tool rack according to claim 3, wherein said means comprises first and second sets of retaining clips engaging the lower handle assembly on opposite surfaces.

5. The hose and tool rack according to claim 4, wherein said first set of retainer clips is adapted to engage slots in one surface of the lower handle and a second set of retainer clips is adapted to engage an edge of an opposite surface of the lower handle assembly.

6. The hose and tool rack according to claim 3, wherein said upper cross strut defines a pocket nestingly receiving a top end of the lower handle assembly.

7. The hose and tool rack according to claim 6, wherein said lower cross strut defines a channel matingly engaging a bottom end of the lower handle assembly.

8. The hose and tool rack according to claim 7, wherein said pocket has an open back and said channel has an open front, said pocket and channel transversely engaging the lower handle assembly.

9. The hose and tool rack according to claim 8, wherein said frame is flexible and forgiving, accommodating deflection of said frame around the lower handle assembly to effect engagement of said means to the lower handle assembly.

10. The hose and tool rack according to claim 3, wherein said hose clips comprise a pair of spaced apart arcuate clips extending from each of said vertical side strut members with an arcuate retainer interposed between the arcuate clips of each pair.

11. The hose and tool rack according to claim 10, wherein said arcuate clips are positioned to engage the hose on a side opposite engagement by said interposed arcuate retainer.

12. The hose and tool rack according to claim 3, wherein said at least one cleaning tool comprises a crevice tool, said frame having a blade member extending therefrom for receiving a working end of said crevice tool and a deflection member for directing said working end onto said blade member.

13. The hose and tool rack according to claim 3, further comprising first and second receptacles and respective bottom portions of each of said vertical side strut members, said first and second receptacles receiving and maintaining opposite ends of the hose.

14. The hose and tool rack according to claim 13, wherein said first receptacle is tubular and said second receptacle is conical.

15. A method for attaching a rectangularly shaped hose and tool rack having a central aperture to a vacuum cleaner, comprising:

placing the hose and tool rack over a handle of the vacuum cleaner, causing said handle to pass through the aperture;

engaging a top portion of the hose and tool rack with a top portion of a lower handle assembly of the vacuum cleaner;

engaging a bottom portion of the hose and tool rack with a bottom portion of the lower handle assembly of the vacuum cleaner and attaching the hose and tool rack to the vacuum cleaner;

16. The method according to claim 15, wherein said step of engaging said bottom portion of the hose and tool rack with the lower handle assembly includes the step of bending and deflecting said bottom portion of the hose and tool rack about said bottom portion of the lower handle assembly.

17. The method according to claim 16, wherein said top and bottom portions of the hose and tool rack assembly are respectively engaged with top front and bottom back portions of the lower handle assembly, the hose and tool rack transversely mounting the lower handle assembly.

18. The method according to claim 17, wherein the attaching step further comprises the steps of engaging a first set of clips on the tool and rack assembly with slots in a back surface of the lower handle assembly and a second set of clips on the tool and rack assembly with edges of a front surface of the lower handle assembly.

19. The method according to claim 18, wherein said first and second sets of clips are deflected over said lower handle assembly.

20. The method according to claim 18, wherein said lower handle assembly is brought into substantially congruent nesting engagement with the hose and tool rack within said aperture.

21. The combined product of a vacuum cleaner and hose and tool rack with a central aperture, said hose and tool rack mounted on said vacuum cleaner and made by a method comprising:

placing the hose and tool rack over a handle of the vacuum cleaner, causing the handle to pass through the aperture; engaging a top portion of the hose and tool rack with a top portion of a lower handle assembly of the vacuum cleaner;

engaging a bottom portion of the hose and tool rack with a bottom portion of the lower handle assembly of the vacuum cleaner; and attaching the hose and tool rack to the vacuum cleaner.

* * * * *